US005781971A

United States Patent [19]

Petersen, III

[11] Patent Number: 5,781,971

[45] Date of Patent: Jul. 21, 1998

[54] SEAT BELT BUCKLE WITH INERTIA LOCKING MECHANISM

[75] Inventor: Carl M. Petersen, III, Waterford, Mich.

[73] Assignee: TRW Vehicle Safety Systems Inc., Lyndhurst, Ohio

[21] Appl. No.: 802,561

[22] Filed: Feb. 19, 1997

[51] Int. Cl.[6] ..... A44B 11/00

[52] U.S. Cl. ..... 24/633; 24/642

[58] Field of Search ..... 24/633, 642, 641, 24/636; 280/806; 297/480

[56] References Cited

U.S. PATENT DOCUMENTS

| | | | |
|---|---|---|---|
| 4,597,141 | 7/1986 | Wier | 24/633 |
| 5,163,207 | 11/1992 | Krautz et al. . | |
| 5,195,224 | 3/1993 | Bock et al. . | |
| 5,216,788 | 6/1993 | Bock . | |
| 5,309,611 | 5/1994 | Wier et al. . | |
| 5,496,068 | 3/1996 | Ball et al. . | |
| 5,522,619 | 6/1996 | Collins . | |
| 5,595,400 | 1/1997 | Wier | 24/642 |

FOREIGN PATENT DOCUMENTS

| | | | |
|---|---|---|---|
| 2732401 | 1/1978 | Germany | 24/642 |
| 1589059 | 5/1981 | United Kingdom | 24/642 |

*Primary Examiner*—Victor N. Sakran
*Attorney, Agent, or Firm*—Tarolli, Sundheim, Covell Tummino & Szabo

[57] ABSTRACT

A seat belt buckle (16) includes a latch mechanism (22), a pushbutton (24), an inertia member (100) and a spring (102). The pushbutton (24) has a release position in which it releases a seat belt tongue (14) from the latch mechanism (22). The inertia member (100) has a blocking position in which it prevents the pushbutton (24) from moving to the release position. The buckle (16) further includes structure (126, 128) which supports the inertia member (100) for inertial movement from a non-blocking position to the blocking position against a bias of the spring (102). The supporting structure (126, 128) is free of a pivotal bearing.

26 Claims, 4 Drawing Sheets

SEAT BELT BUCKLE WITH INERTIA LOCKING MECHANISM

FIELD OF THE INVENTION

The present invention relates to a seat belt buckle, and particularly relates to a seat belt buckle for use with a seat belt pretensioner.

BACKGROUND OF THE INVENTION

A seat belt system for restraining a vehicle occupant typically includes seat belt webbing, a seat belt locking tongue on the webbing, and a seat belt buckle. The tongue on the webbing is inserted and locked in the buckle to secure the webbing about a vehicle occupant. The tongue is released from the buckle when a pushbutton on the buckle is moved to a release position.

A seat belt system may also include a seat belt pretensioner which is actuated upon the occurrence of a vehicle collision. The pretensioner then moves the buckle so as to pull the tongue and the webbing against the vehicle occupant. This imparts tension to the webbing to help ensure that the webbing restrains movement of the vehicle occupant.

When the buckle decelerates and stops moving under the influence of the pretensioner, the pushbutton on the buckle may tend to continue moving inertially toward the release position. Therefore, a buckle used with a pretensioner may include an inertia locking assembly which prevents the pushbutton from moving to the release position under the influence of the pretensioner. The inertia locking assembly includes an inertia member and a spring. The inertia member is supported for pivotal movement against a bias of the spring. The inertia member is thus movable inertially to a blocking position in which it prevents the pushbutton from moving to the release position.

SUMMARY OF THE INVENTION

In accordance with the present invention, a seat belt buckle includes a latch mechanism, a pushbutton, an inertia member and a spring. The pushbutton has a release position in which it releases a seat belt tongue from the latch mechanism. The inertia member has a blocking position in which it prevents the pushbutton from moving to the release position.

The buckle further comprises means for supporting the inertia member for inertial movement from a non-blocking position to the blocking position against a bias of the spring. The supporting means is free of a pivotal bearing.

A seat belt buckle constructed in accordance with the present invention avoids the manufacturing and assembly tolerance effects associated with prior art buckles in which an inertia member is supported for pivotal movement between non-blocking and blocking positions. This is because the means for supporting the inertia member in accordance with the present invention is free of a pivotal bearing.

In a preferred embodiment of the present invention, the means for supporting the inertia member consists of a plurality of fasteners The fasteners anchor the spring in the buckle, and fix the inertia member to the spring. The spring in the preferred embodiment is a leaf spring which bends under the influence of an inertial force imparted to the leaf spring by the inertia member. When the leaf spring bends in this manner, it suspends the inertia member such that the inertia member moves from the non-blocking position to the blocking position without support from other parts of the buckle. Accordingly, in addition to avoiding the tolerance effects of a pivotal bearing, the present invention avoids friction between the inertia member and other parts of the buckle.

BRIEF DESCRIPTION OF THE DRAWINGS

Further features of the present invention will become apparent to those skilled in the art to which the present invention relates from reading the following description with reference to the accompanying drawings, in which.

DESCRIPTION OF PREFERRED EMBODIMENT

Figure 1:
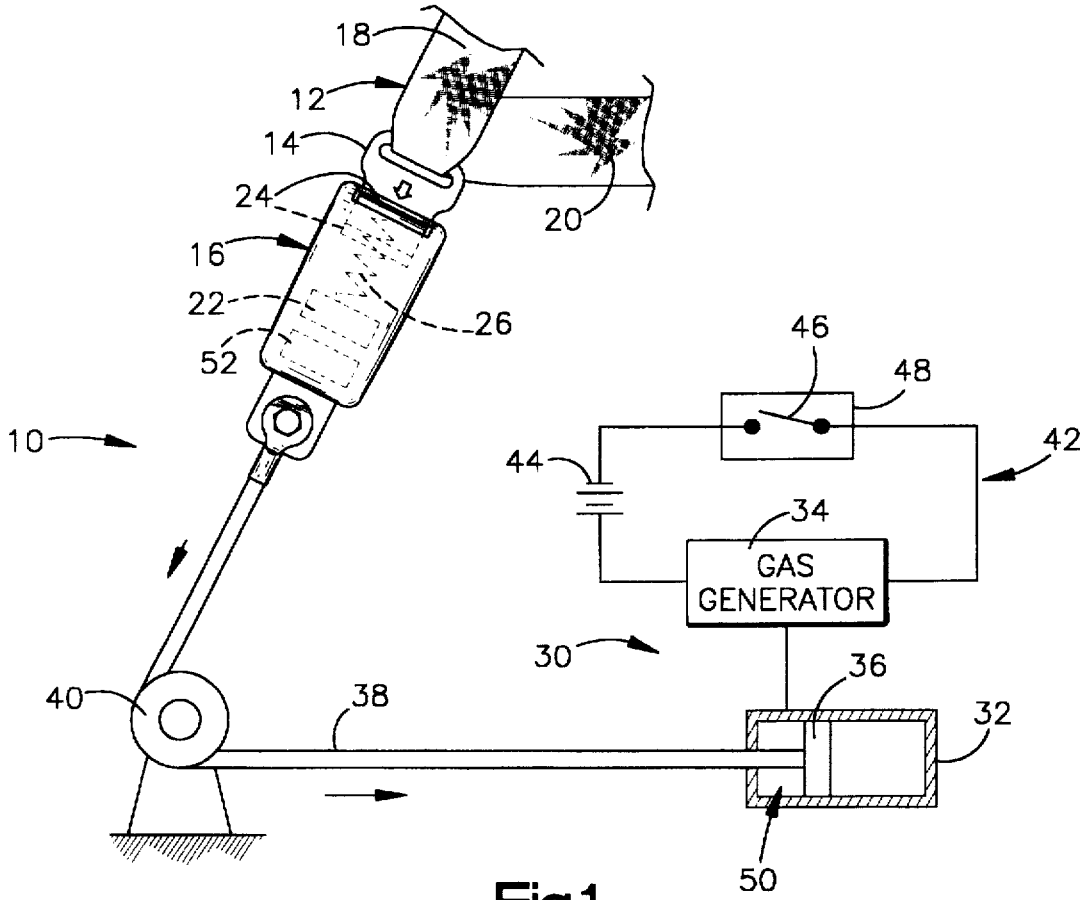
FIG. 1 is a schematic view of a vehicle occupant restraint apparatus comprising a first embodiment of the present invention.

A vehicle occupant restraint apparatus 10 comprising a first embodiment of the present invention is shown schematically in FIG. 1. The apparatus 10 includes seat belt webbing 12, a seat belt locking tongue 14 on the webbing 12, and a seat belt buckle 16. The tongue 14 is inserted and locked in the buckle 16 when the webbing 12 has been moved about a vehicle occupant to define a shoulder belt 18 and a lap belt 20 on opposite sides of the tongue 14. When the tongue 14 is locked in the buckle 16, the webbing 12 can restrain movement of the occupant upon the occurrence of a vehicle collision.

The buckle 16 includes a latch mechanism 22 which releasably interlocks with the tongue 14. A pushbutton 24 cooperates with the latch mechanism 22 to release the tongue 14 from the buckle 16. Specifically, the pushbutton 24 is movable from a rest position, as shown in solid lines in FIG. 1, to a release position, as shown in dashed lines in FIG. 1, against the bias of a pushbutton spring 26. The tongue 14 is released from the latch mechanism 22 when the pushbutton 24 reaches the release position.

The apparatus 10 further includes a seat belt pretensioner 30 which is actuated upon the occurrence of a vehicle collision. When the pretensioner 30 is actuated, it imparts tension to the webbing 12 to help ensure that the webbing 12 restrains movement of the vehicle occupant. In the preferred embodiment of the present invention shown in the drawings, the pretensioner 30 includes a pressure cylinder 32 and a source 34 of fluid pressure. A piston 36 in the cylinder 32 is connected to the buckle 16 by a cable 38 extending around a pulley 40. The source 34 of fluid pressure preferably comprises a pyrotechnic gas generator which is actuatable electrically.

The gas generator 34 is included in an electrical circuit 42 with a power source 44 and a normally open switch 46. The power source 44 preferably comprises the vehicle battery and/or a capacitor. The switch 46 is part of a sensor 48 which senses a vehicle condition indicating the occurrence of a vehicle collision. Such a condition may comprise, for example, sudden vehicle deceleration that is caused by a collision. If the collision-indicating condition is above a predetermined threshold level, the switch 46 closes. Electric current then flows through the circuit 42 to actuate the gas generator 34.

When the gas generator 34 is actuated, it pressurizes a chamber 50 adjacent to the piston 36. This causes the piston 36 to move in the cylinder 32, from left to right as viewed in FIG. 1, and to pull the cable 38 around the pulley 40 toward the cylinder 32. The buckle 16, the tongue 14, and the webbing 12 are then pulled toward the pulley 40 by the cable 38. As a result, tension is imparted to the webbing 12 to increase the restraining effect of the webbing 12.

After the pretensioner 30 has been actuated, the piston 36 decelerates and stops moving to the right in the cylinder 32. The buckle 16 similarly decelerates and stops moving toward the pulley 40. However, the pushbutton 24 may tend to continue moving inertially toward the pulley 40 when the buckle 16 decelerates and stops. The pushbutton 24 thus may tend to move toward the release position in which it releases the tongue 14 from the latch mechanism 22. In accordance with the present invention, the buckle 16 includes an inertia locking assembly 52. As described fully below, the inertia locking assembly 52 prevents the tongue 14 from being inadvertently released from the latch mechanism 22 when the buckle 16 decelerates and stops moving under the influence of the pretensioner 30.

The latch mechanism 22 may comprise any structure capable of releasably interlocking with the tongue 14 in cooperation with the pushbutton 24. One such latch mechanism is disclosed in U.S. Pat. No. 5,496,068 entitled "Seat Belt Buckle," and assigned to TRW Vehicle Safety Systems Inc. As shown schematically by way of example in FIGS. 2–4, the latch mechanism 22 in the first embodiment of the present invention has a plurality of known parts including an ejector 60 and a latch 62.

Figure 2:
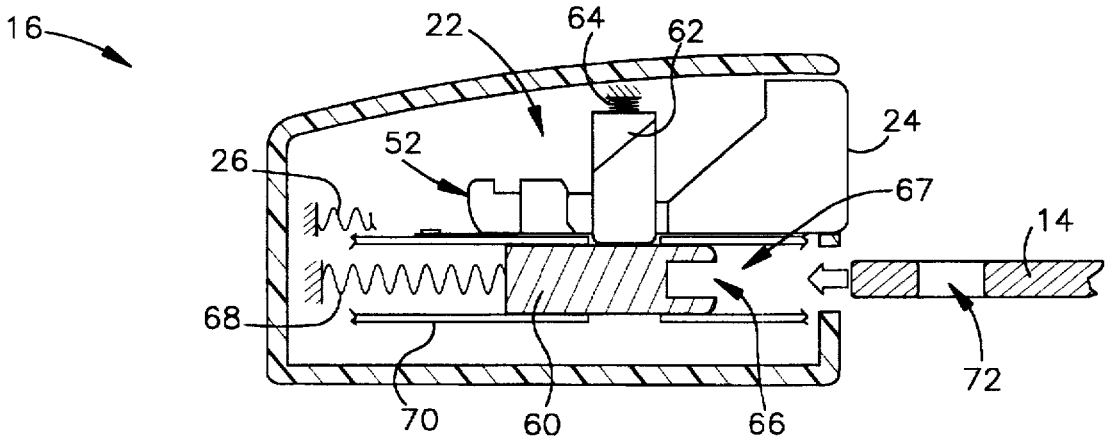
FIG. 2 is a side view, partly in section, of parts of the apparatus of FIG. 1.
Figure 3:
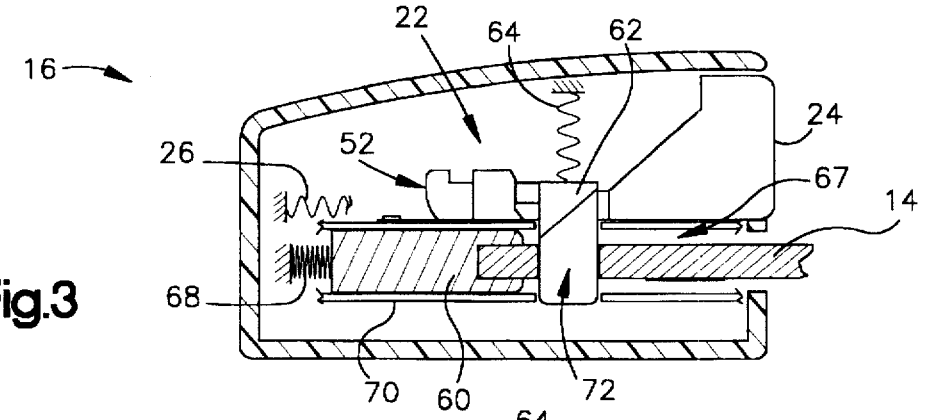
FIG. 3 is a side view similar to FIG. 2 showing parts in different positions.

The latch 62 is movable between a non-locking position (FIG. 2) and a locking position (FIG. 3). When the tongue 14 is located outside the buckle 16, as shown in FIG. 2, the ejector 60 holds the latch 62 in the non-locking position against the bias of a latch spring 64.

When the tongue 14 is inserted in the buckle 16, as indicated by the arrow shown in FIG. 2, it is moved into engagement with the ejector 60 in a notch 66 at the end of the ejector 60. The tongue 14 is then moved inward against the ejector 60 so as to push the ejector 60 along a guide track 67 from a forward position (FIG. 2) to a rearward position (FIG. 3) against the bias of an ejector spring 68. The guide track 67 is defined by a base 70 which supports the other parts of the buckle 16.

As the tongue 14 and the ejector 60 approach the positions of FIG. 3, an aperture 72 in the tongue 14 moves into alignment with the latch 62. The latch spring 64 then moves the latch 62 to the locking position through the aperture 72 in the tongue 14. The tongue 14 is thus interlocked with the latch mechanism 22.

Figure 4:
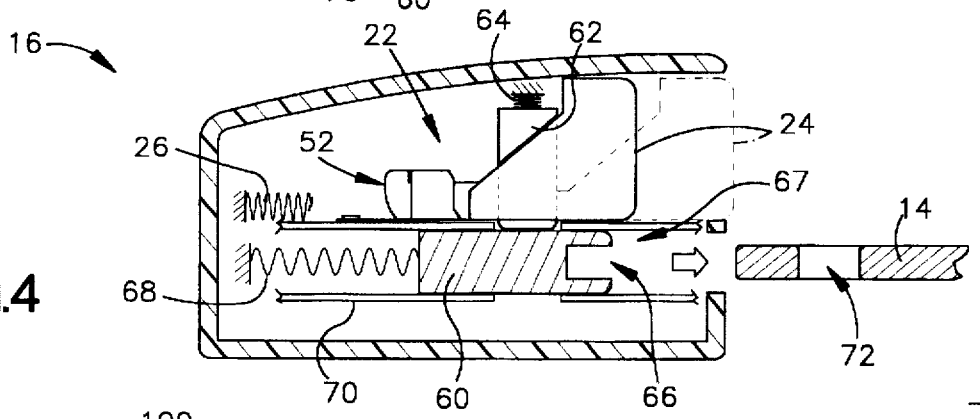
FIG. 4 is a side view similar to FIGS. 2 and 3 showing parts in different positions.

When the tongue 14 is to be released from the buckle 16, the pushbutton 24 is moved from the rest position of FIGS. 2 and 3 to the release position of FIG. 4 against the bias of the pushbutton spring 26. The pushbutton 24 engages the latch 62 in a known manner so as to move the latch 62 back out of the aperture 72 in the tongue 14 against the bias of the latch spring 64. The ejector spring 68 then moves the ejector 60 back outward along the guide track 67 to eject the tongue 14 from the buckle 16.

Figure 5:
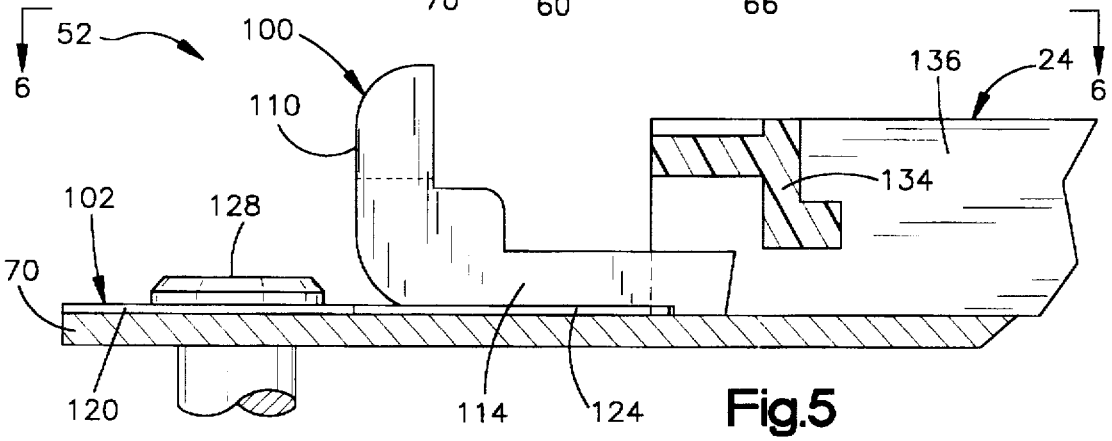
FIG. 5 is an enlarged partial view of parts shown in FIGS. 2–4.
Figure 7:
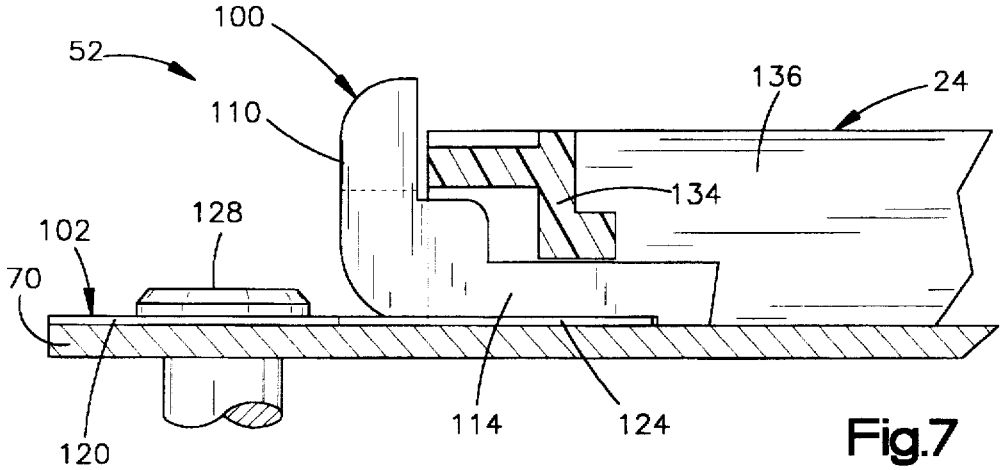
FIG. 7 is a view similar to FIG. 5 showing parts in different positions.
Figure 8:
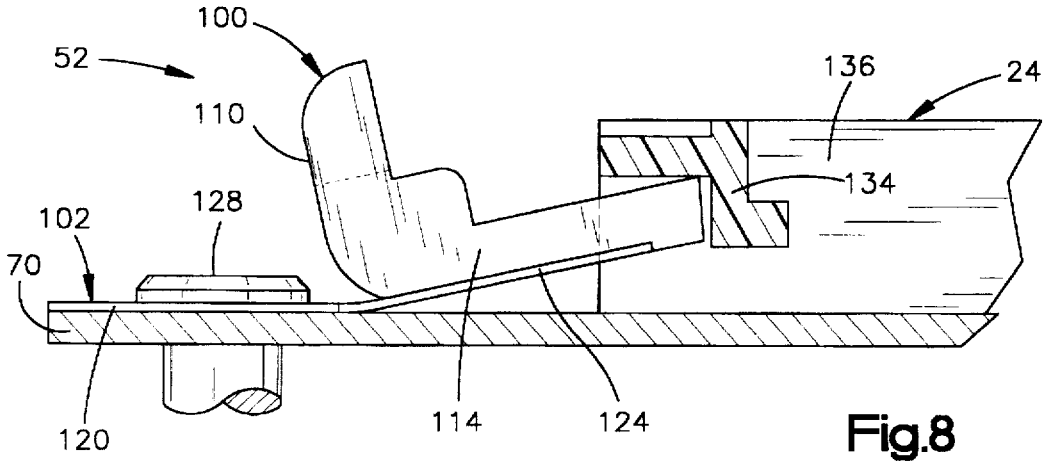
FIG. 8 also is a view similar to FIG. 5 showing parts in different positions.

The inertia locking assembly 52 is mounted on the base 70 at a location to the rear of latch mechanism 22 and the pushbutton 24. As shown in greater detail in FIGS. 5–8, the inertia locking assembly 52 includes an inertia member 100 and a leaf spring 102. The inertia member 100 is mounted on the leaf spring 102. The leaf spring 102, in turn, is mounted on the base 70. The leaf spring 102 supports the inertia member 100 for inertial movement from a non-blocking position, as shown in FIG. 5, to a blocking position, as shown in FIG. 8. When the inertia member 100 is in the blocking position, it blocks movement of the pushbutton 24 to the release position.

Figure 6:
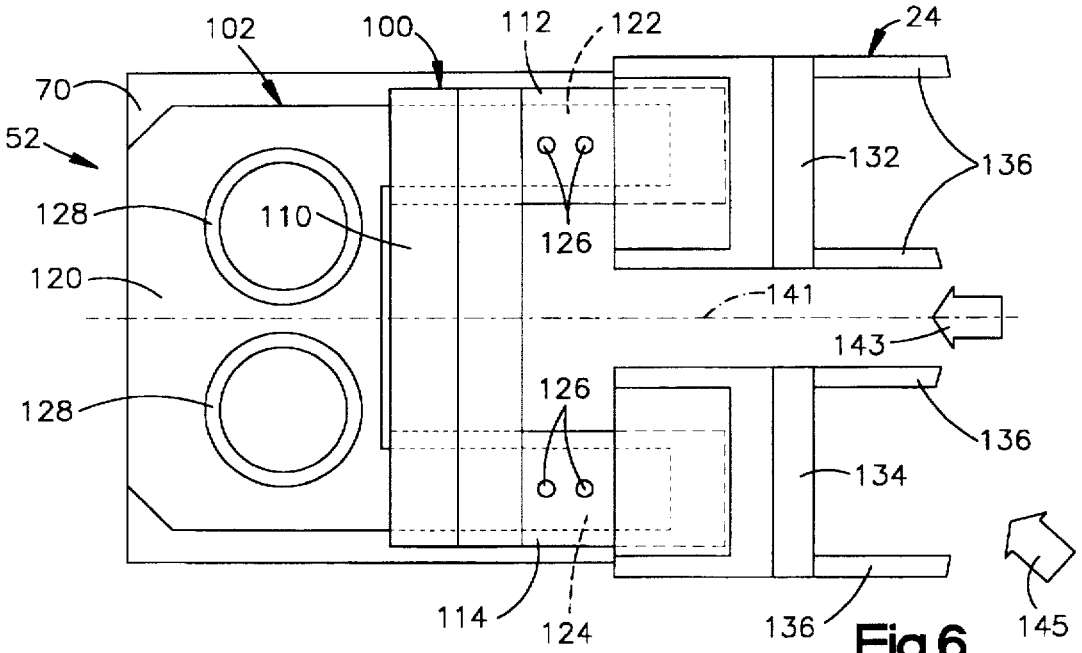
FIG. 6 is taken on line 6—6 of FIG. 5.

As shown in FIG. 6, the inertia member 100 is a generally U-shaped part with a base 110 and a pair of parallel blocking arms 112 and 114 projecting from the base 110. The leaf spring 102 similarly has a generally U-shaped configuration defined by a base 120 and a pair of parallel spring arms 122 and 124 projecting from the base 120. The blocking arms 112 and 114 are fixed to the spring arms 122 and 124 by respective pairs of rivets 126. Although the first embodiment of the present invention uses the rivets 126, any other suitable fasteners or fastening structures, such as, for example, machine screws, welds, or swaged bosses on the blocking arms 112 and 114, could be used as alternatives for the rivets 126. A pair of larger fasteners 128 fix the base 120 of the leaf spring 102 to the base 70 of the buckle 16. The larger fasteners 128 preferably are rivets which fasten an anchor cable (not shown) to the buckle 16 in a known manner.

The inertia member 100 normally rests on the base 70 of the buckle 16, as shown in FIG. 5. More specifically, the leaf spring 102 normally has a substantially flat, slightly prestressed condition in which the spring arms 122 and 124 rest on the base 70 in overlying surface contact to hold the inertia member 100 against the base 70 in the non-blocking position.

The blocking arms 112 and 114 are located beneath corresponding abutment parts 132 and 134 of the pushbutton 24 when the inertia member 100 is in the non-blocking position. Each of the abutment parts 132 and 134 of the pushbutton 24 is located between a respective pair of rear wall portions 136 of the pushbutton 24. When a vehicle occupant moves the pushbutton 24 from the rest position to the release position to release the tongue 14 from the buckle 16, the rear wall portions 136 of the pushbutton 24 slide along the base 70 in a direction extending from right to left, as viewed in FIGS. 5–7. The abutment parts 132 and 134 of the pushbutton 24 then move over the blocking arms 112 and 114 on the inertia member 100 without contacting the blocking arms 112 and 114.

As described above with reference to FIG. 1, the pretensioner 30 moves the buckle 16 in a direction toward the pulley 40 when the pretensioner 30 is actuated. That direction extends from right to left in the views of FIGS. 5–8. Accordingly, as the buckle 16 decelerates and stops moving toward the pulley 40 under the influence of the pretensioner 30, the mass of the pushbutton 24 tends to cause it to move inertially from the rest position (FIG. 5) toward the release position (FIG. 7). The mass of the inertia member 100 similarly urges it to move in the same direction. This causes the inertia member 100 to move against the bias of the leaf spring 102 from the position of FIG. 5 to the position of FIG. 8. More specifically, inertial forces acting on the inertia member 100 are imparted to the leaf spring 102 as bending forces which deflect the spring arms 122 and 124 away from the base 70 as the inertia member 100 tilts rearwardly toward the position of FIG. 8. Importantly, the mass and the shape of the inertia member 100 are designed to cause it to tilt fully to the position of FIG. 8 in response to the amount of deceleration that occurs when the buckle 16 stops moving toward the pulley 40 under the influence of the pretensioner 30. The blocking arms 112 and 114 then move into the path of movement of the abutment parts 132 and 134 of the pushbutton 24 to block the pushbutton 24 from moving fully to its release position. The inertial forces acting on the pushbutton 24 and the inertia member 100 are then dissipated, and those parts are returned to their original positions by the pushbutton spring 26 and the leaf spring 102, respectively.

As thus far described, the inertia member 100 is supported by the leaf spring 102 for movement under the influence of an inertial force acting along a longitudinal centerline 141 (FIG. 6) of the pushbutton, as indicated by the arrow 143 shown in FIG. 6. In accordance with a specific feature of the present invention, the inertia member 100 is further supported by the leaf spring 102 for movement under the influence of an inertial force which is transverse to the longitudinal centerline 141, as indicated by the arrow 145 shown in FIG. 6. Such a transversely acting inertial force would cause the inertia member 100 to tilt rearwardly in a manner similar to that described above, but would also cause the inertia member 100 to tilt transversely in the direction of the arrow 145. The second blocking arm 114 and the second spring arm 124 would then move away from the base 70 farther than the first blocking arm 112 and the first spring arm 122. The leaf spring 102 can twist between the rivets 128 at the base 120 and the rivets 126 at the spring arms 122 and 124 so that the inertia member 100 can move, i.e., rotate about the centerline 141, in this manner. The inertia member 100 could then reach a blocking position in which only the second blocking arm 114 engages its corresponding abutment part 134 to block movement of the pushbutton 24 fully to the release position. A transversely opposite inertia force could rotate the inertia member 100 oppositely about the centerline 141 to a rotationally spaced blocking position in which only the first blocking arm 112 engages its corresponding abutment part 132 of the pushbutton 24.

Figure 9:
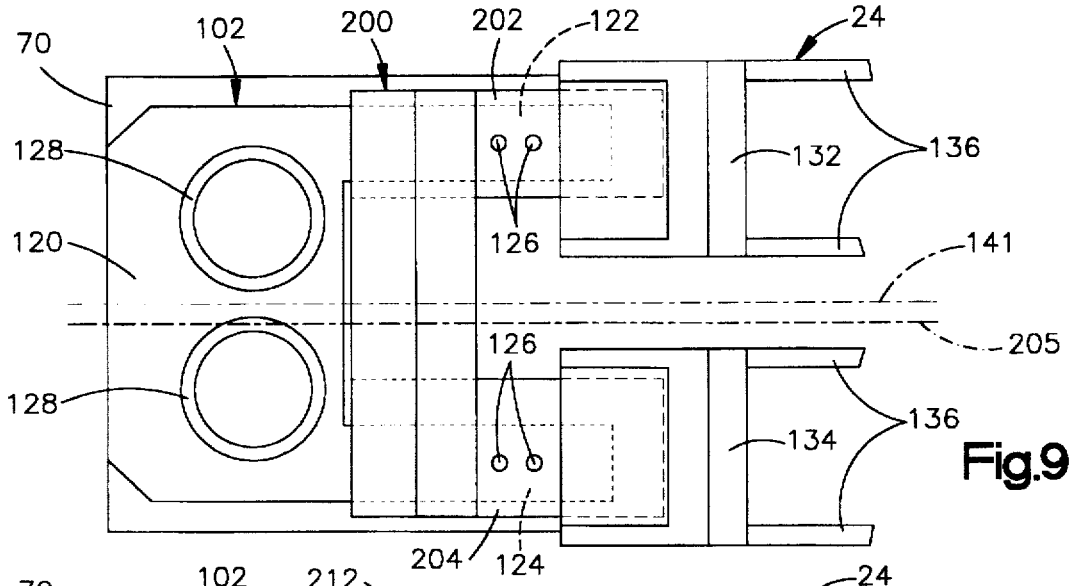
FIG. 9 is a view similar to FIG. 6 showing parts of a second embodiment of the present invention.

The inertia member 100 is suspended by the leaf spring 102 throughout its path of movement between the nonblocking position and the blocking position. Accordingly, movement of the inertia member 100 between those positions is guided entirely by the leaf spring 102. This enables the inertia member 100 to experience simultaneous tilting and rotational movement upon deflection of the leaf spring 102 under the influence of inertial forces acting on the inertia member 100, as described above. As shown partially in FIG. 9, a second embodiment of the present invention includes an alternative inertia member 200 with a configuration that promotes such simultaneous tilting and rotational movement.

The second embodiment of the present invention includes the alternative inertia member 200, but is otherwise the same as the first embodiment. This is indicated by the use of the same reference numbers for corresponding parts shown in FIGS. 9 and 6. In the second embodiment, the inertia member 200 has first and second blocking arms 202 and 204 with unequal masses, whereas the first and second blocking arms 112 and 114 on the inertia member 100 have equal masses. The center of mass of the inertia member 200 is thus located on a line 205 which is spaced transversely from the centerline 141 in a direction toward the more massive blocking arm 204, whereas the center of mass of the inertia member 100 is located on the centerline 141. This causes the first and second blocking arms 202 and 204 to tilt and rotate unequally under the influence of a given inertial force acting on the inertia member 200.

The unequal tilting and rotational movement experienced by the blocking arms 202 and 204 increases the time during which one or both of the blocking arms 202 and 204 extends into the path of movement of the abutment parts 132 and 134 of the pushbutton 24. The inertia member 200 thus tends to dwell in a blocking position longer than inertia member 100. A dwell effect could similarly be provided in the first embodiment of the invention by providing the spring arms 122 and 124 with unequal spring constants.

Figure 10:
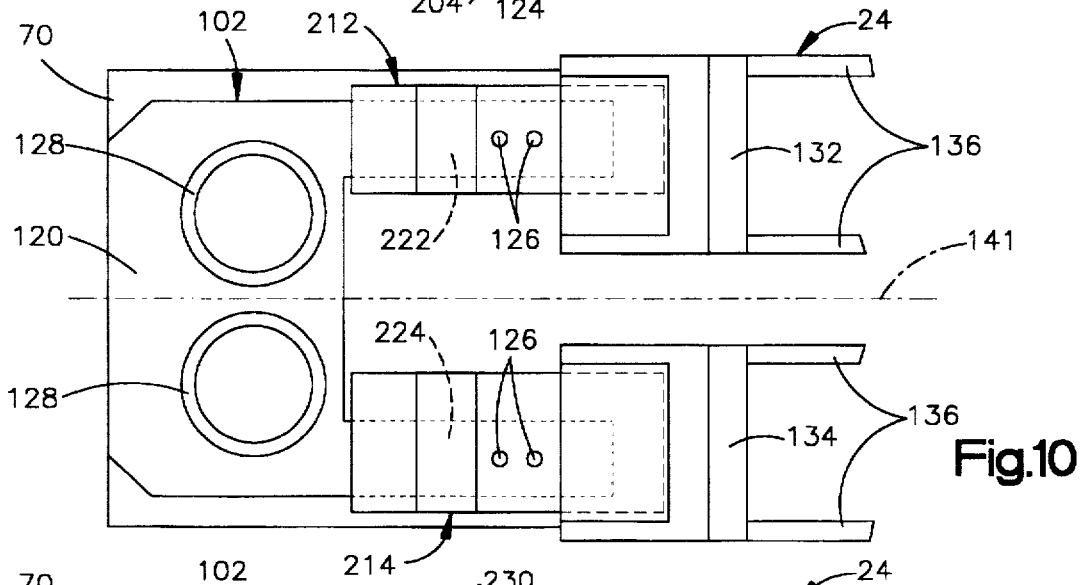
FIG. 10 is a view similar to FIG. 6 showing parts of a third embodiment of the present invention.

A third embodiment of the present invention is shown partially in FIG. 10. In the third embodiment, a pair of separate inertia members 212 and 214 are mounted on a corresponding pair of spring arms 222 and 224. The inertia members 212 and 214 have unequal masses. The spring arms 222 and 224 have equal spring constants. Accordingly, the inertia members 212 and 214 in the third embodiment of the present invention move unequally under the influence of a given amount of deceleration so as to provide a dwell effect similar to the dwell effect described above with reference to the second embodiment.

Figure 11:
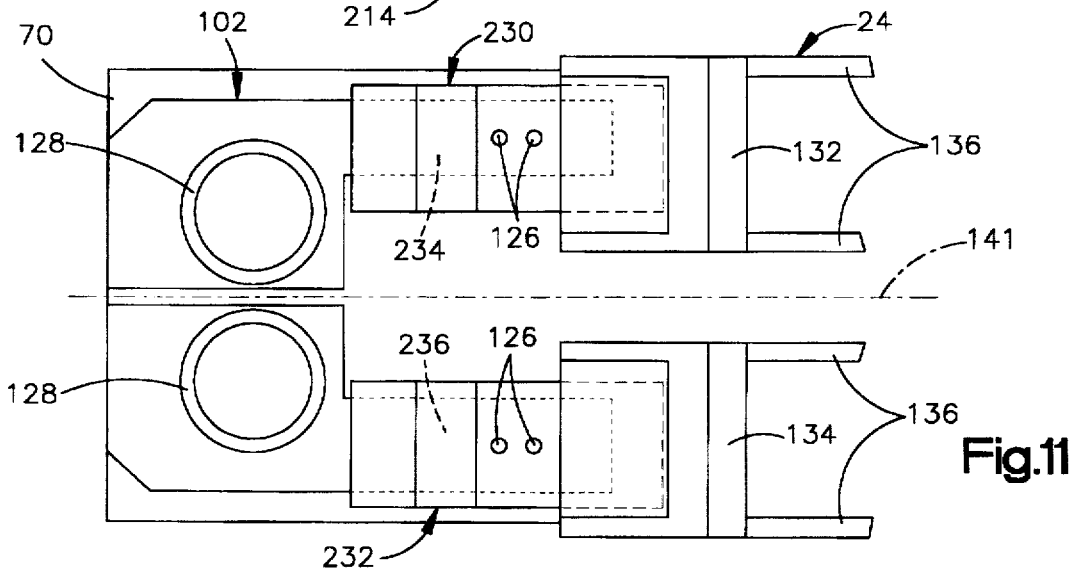
FIG. 11 is a view similar to FIG. 6 showing parts of a fourth embodiment of the present invention.

FIG. 11 shows parts of a fourth embodiment of the present invention. In the fourth embodiment, a pair of separate inertia members 230 and 232 are mounted on a corresponding pair of separate springs 234 and 236. The inertia members 230 and 232 have equal masses. The springs 234 and 236 have unequal spring constants. Accordingly, the inertia members 230 and 232 in the fourth embodiment move unequally under the influence of a given amount of deceleration to provide a dwell effect similar to the dwell effects described above with reference to the second and third embodiments.

Figure 12:
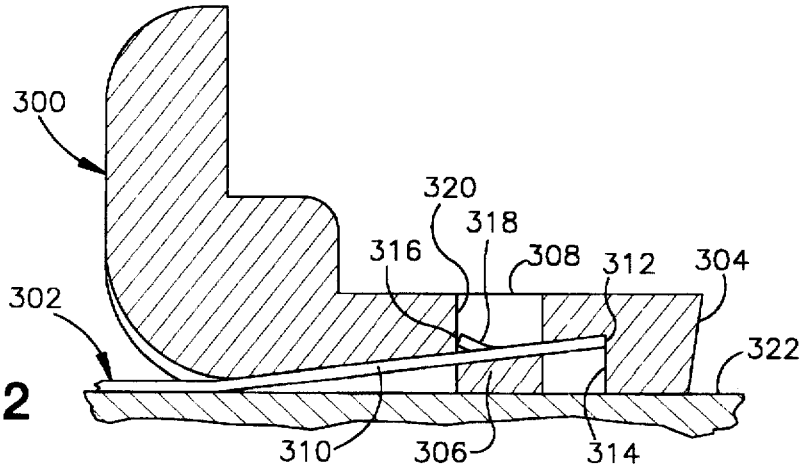
FIG. 12 is a view similar to FIGS. 7 and 8 showing parts of a fifth embodiment of the present invention.

FIG. 12 shows parts of a fifth embodiment of the present invention. The fifth embodiment includes an inertia member 300 and a spring 302, and has an alternative means for supporting the inertia member 300 on the spring 302. Specifically, the inertia member 300 has a blocking arm 304 with a mounting block portion 306 and a major body portion 308. The spring 302 has a spring arm 310 received between the mounting block portion 306 and the major body portion 308 of the blocking arm 304. A forward edge surface 312 of the spring arm 310 abuts an opposed surface 314 of the blocking arm 304. A rearwardly facing edge surface 316 of the spring arm 310, which is defined on a raised tab 318, similarly abuts a corresponding opposed surface 320 of the blocking arm 304. In this configuration, the spring arm 310 and the blocking arm 304 are securely interlocked with each other. Like each of the springs described above, the spring 302 can be either pre-stressed or unstressed when it holds the inertia member 300 against a corresponding base 322.

From the foregoing description of the invention, those skilled in the art will perceive improvements, changes and modifications. For example, the leaf spring 102 in the first embodiment of the present invention is slightly pre-stressed by the inertia member 100, and is further stressed upon movement of the inertia member 100 toward the blocking position. Such pre-stressing could be enhanced, for example, by a bow or crimp between the rivets 128 and the inertia member 100. A corresponding spring in an alternative embodiment could normally have an unstressed condition when the corresponding inertia member is in its non-blocking position. Moreover, one or more blocking arms centered on the longitudinal centerline 141 could be used instead of transversely spaced blocking arms. Such improvements, changes and modifications within the skill of the art are intended to be covered by the appended claims.

Having described the invention, the following is claimed:

1. Apparatus comprising:

a latch mechanism;

a pushbutton having a release position in which said pushbutton releases a seat belt tongue from said latch mechanism;

an inertia member having a blocking position preventing said pushbutton from moving to said release position;

a spring; and means for supporting said inertia member for inertial movement from a non-blocking position to said blocking position against a bias of said spring, said supporting means being free of a pivotal bearing.

2. Apparatus as defined in claim 1 wherein said supporting means consists of means for anchoring said spring in said buckle and for fixing said inertia member to said spring.

3. Apparatus as defined in claim 2 wherein said supporting means comprises fasteners which interconnect said inertia member and said spring.

4. Apparatus as defined in claim 2 wherein said supporting means comprises interlocking portions of said inertia member and said spring.

5. Apparatus as defined in claim 1 wherein said spring is pre-stressed by said inertia member when said inertia member is in said non-blocking position.

6. Apparatus as defined in claim 1 wherein said inertia member is one of a pair of separate inertia members having unequal masses.

7. Apparatus comprising:

a latch mechanism;

a pushbutton having a release position in which said pushbutton releases a seat belt tongue from said latch mechanism;

a spring; and an inertia member which is movable inertially against a bias of said spring from a non-blocking position to a blocking position extending into the path of movement of said pushbutton to block movement of said pushbutton to said release position;

said inertia member being suspended by said spring upon moving to said blocking position.

8. Apparatus as defined in claim 7 wherein said spring is pre-stressed by said inertia member when said inertia member is in said non-blocking position.

9. Apparatus as defined in claim 7 wherein said inertia member has a non-blocking position resting on a base and is spaced from said base when in said blocking position.

10. Apparatus as defined in claim 7 wherein said inertia member is one of a pair of separate inertia members having unequal masses.

11. Apparatus comprising:

a latch mechanism;

a pushbutton having a release position in which said pushbutton releases a seat belt tongue from said latch mechanism;

an inertia member having a blocking position preventing said pushbutton from moving to said release position;

a spring; and means for supporting said inertia member for inertial movement from a non-blocking position to said blocking position against a bias of said spring, said supporting means being free of a pivotal bearing;

said inertia member resting on a base when in said non-blocking position and being spaced from said base when in said blocking position, said inertia member being suspended by said spring upon moving from said non-blocking position to said blocking position.

12. Apparatus as defined in claim 11 wherein said spring is a leaf spring having a first portion which is fixed relative to said base and a second portion which is movable relative to said base, said inertia member being fixed to said second portion of said leaf spring.

13. Apparatus as defined in claim 12 wherein said second portion of said leaf spring includes first and second spring arms which are deflectable relative to each other, said inertia member having first and second blocking arms respectively supported by said first and second spring arms, said blocking position being one of a plurality of blocking positions including a position in which only said first blocking arm prevents said movement of said pushbutton and a position in which only said second blocking arm prevents said movement of said pushbutton.

14. Apparatus as defined in claim 13 wherein said blocking positions further include a position in which both of said blocking arms prevent said movement of said pushbutton.

15. Apparatus as defined in claim 13 wherein said blocking arms have unequal masses.

16. Apparatus as defined in claim 13 wherein said spring arms have unequal spring constants.

17. Apparatus comprising:

a latch mechanism;

a pushbutton having a release position in which said pushbutton releases a seat belt tongue from said latch mechanism;

an inertia member having a blocking position preventing said pushbutton from moving to said release position;

a spring;

means for supporting said inertia member for inertial movement from a non-blocking position to said blocking position against a bias of said spring, said supporting means being free of a pivotal bearing; and, said inertia member being one of a pair of inertia members, said spring being one of a pair of springs having unequal spring constants, said supporting means supporting each of said inertia members for inertial movement to a blocking position against a bias of a corresponding one of said springs.

18. Apparatus comprising:

a latch mechanism;

a pushbutton having a release position in which said pushbutton releases a seat belt tongue from said latch mechanism;

a spring; and an inertia member which is movable inertially against a bias of said spring from a non-blocking position to a blocking position extending into the path of movement of said pushbutton to block movement of said pushbutton to said release position;

said inertia member being suspended by said spring upon moving to said blocking position;

said pushbutton being movable to said release position in a direction extending along a centerline of said pushbutton, said spring supporting said inertia member for rotational movement about said centerline, said blocking position being one of a plurality of blocking positions which are rotationally spaced from each other about said centerline.

19. Apparatus as defined in claim 18 wherein said inertia member has a center of mass spaced transversely from said centerline.

20. Apparatus as defined in claim 18 wherein said inertia member has first and second blocking arms projecting toward said pushbutton, said blocking positions including a first blocking position in which only said first blocking arm blocks said movement of said pushbutton and a second blocking position in which only said second blocking arm blocks said movement of said pushbutton.

21. Apparatus comprising:

a latch mechanism;

a pushbutton having a release position in which said pushbutton releases a seat belt tongue from said latch mechanism;

a spring; and an inertia member which is movable inertially against a bias of said spring from a non-blocking position to a blocking position extending into the path of movement of said pushbutton to block movement of said pushbutton to said release position;

said inertia member being suspended by said spring upon moving to said blocking position; said inertia member having a non-blocking position resting on a base and being spaced from said base when in said blocking position;

said spring being a leaf spring having a first portion which is fixed relative to said base and a second portion which is movable relative to said base, said inertia member being fixed to said second portion of said leaf spring.

22. Apparatus as defined in claim 21 wherein said second portion of said spring includes first and second spring arms which are deflectable relative to each other, said inertia member having first and second blocking arms respectively supported by said first and second spring arms, said blocking position being one of a plurality of blocking positions including a position in which only said first blocking arm blocks said movement of said pushbutton and a position in which only said second blocking arm blocks said movement of said pushbutton.

23. Apparatus as defined in claim 22 wherein said blocking positions further include a position in which both of said blocking arms block said movement of said pushbutton.

24. Apparatus as defined in claim 22 wherein said blocking arms have unequal masses.

25. Apparatus as defined in claim 22 wherein said spring arms have unequal spring constants.

26. Apparatus comprising:

a latch mechanism;

a pushbutton having a release position in which said pushbutton releases a seat belt tongue from said latch mechanism;

a spring; and an inertia member which is movable inertially against a bias of said spring from a non-blocking position to a blocking position extending into the path of movement of said pushbutton to block movement of said pushbutton to said release position;

said inertia member being suspended by said spring upon moving to said blocking position;

said inertia member being one of a pair of inertia members, said spring being one of a pair of springs having unequal spring constants, said supporting means supporting each of said inertia members for inertial movement to a blocking position against a bias of a corresponding one of said springs.

* * * * *